United States Patent [19]

Odermann et al.

[11] 4,178,865

[45] Dec. 18, 1979

[54] FINGER GUARD FOR SEWING MACHINES

[75] Inventors: Charles R. Odermann, Montville; Ralph E. Johnson, Convent Station, both of N.J.

[73] Assignee: The Singer Company, New York, N.Y.

[21] Appl. No.: 921,032

[22] Filed: Jun. 30, 1978

[51] Int. Cl.[2] ..... D05B 29/12; D05B 83/00

[52] U.S. Cl. ..... 112/261; 112/240; 112/257

[58] Field of Search ..... 112/261, 240, 257; 83/544

[56] References Cited

U.S. PATENT DOCUMENTS

| | | | |
|---|---|---|---|
| 1,069,967 | 8/1913 | Mashbir. | |
| 1,070,823 | 8/1913 | Lavoie et al. | |
| 1,174,973 | 3/1916 | Felsenthal. | |
| 1,307,295 | 6/1919 | Gardner. | |
| 2,080,541 | 5/1937 | Jacobson et al. | 112/261 |
| 2,178,480 | 10/1939 | Lempert | 112/261 |
| 2,317,185 | 4/1943 | Dunlap et al. | |
| 2,541,549 | 2/1951 | Sampson | 112/261 |
| 2,840,023 | 6/1958 | Interrante | 112/261 |
| 3,489,114 | 1/1970 | Seck | 112/240 |
| 3,500,782 | 3/1970 | Smith | 112/261 |

FOREIGN PATENT DOCUMENTS

| | | | |
|---|---|---|---|
| 74075 | 10/1947 | Norway | 112/261 |

*Primary Examiner*—Werner H. Schroeder
*Assistant Examiner*—Andrew M. Falik
*Attorney, Agent, or Firm*—Michael H. Wallach; Robert E. Smith; Edward L. Bell

[57] ABSTRACT

A finger guard for a sewing machine is disclosed which fastens to the presser bar and protectively encloses a portion of the needle. The finger guard permits an operator to easily remove an arcuately rotatable snap on presser foot without the necessity of disturbing the finger guard.

4 Claims, 5 Drawing Figures

FINGER GUARD FOR SEWING MACHINES

BACKGROUND OF THE INVENTION

1. Field of the Invention

This invention relates to sewing machines in general and more particularly to sewing machines constructed with a presser foot which is arcuately rotatable to effectuate removal from the presser bar.

2. Description of the Prior Art

Finger guards for sewing machines are well known in the prior art. Finger guards have not heretofore been designed to cooperate with presser foot attachments which are readily removable from the presser bar. It is advantageous for a sewing machine operator to be able to readily exchange presser feet to suit the special demands of particular sewing situations. One problem associated with prior finger guards is that they make the rapid replacement of a presser foot a cumbersome task. Another problem is that some finger guards must be removed from the presser bar before the presser foot can be easily replaced.

SUMMARY OF THE INVENTION

It is an object of this invention to provide a finger guard for the needle of a sewing machine which permits the convenient replacement of a snap on presser foot.

Still another object is to provide a finger guard which is self-aligning when fastened to the presser bar of a sewing machine.

The disclosed objects and other advantages of this invention are achieved by providing a finger guard which is restrained to the presser bar by a presser clamp screw. The finger guard partially encloses the space penetrated by the needle to present an obstruction to stray hand movement in the stitch forming area of the sewing machine. The walls defining the area enclosed by the finger guard are spaced away from the presser foot, thereby allowing a pivotally mounted presser foot to be arcuately rotated upwardly and removed from the presser foot shank.

BRIEF DESCRIPTION OF THE DRAWINGS

The above and other objects of this invention will become evident from an understanding of the preferred embodiment which is hereinafter set forth in such detail as to enable those skilled in the relevant art to fully understand the function, operation, construction and advantages of it when read in conjunction with the accompanying drawings in which.

DESCRIPTION OF THE PREFERRED EMBODIMENT

Figure 1:
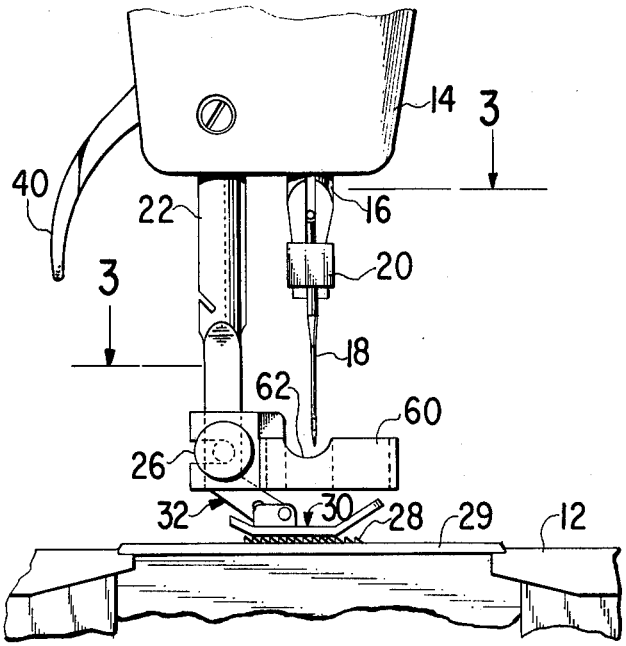
FIG. 1 is a side elevational view of a fragment of a sewing machine illustrating the finger guard of this invention.
Figure 2:
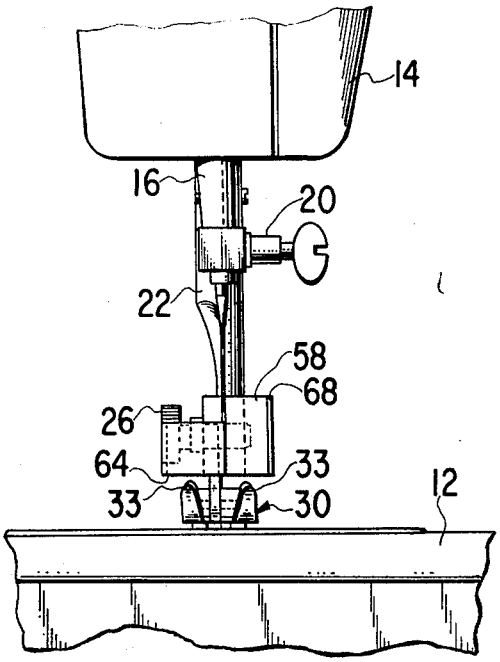
FIG. 2 is a front elevation view similar to FIG. 1.

Referring to the drawings, FIG. 1 illustrates a fragment of a sewing machine having a bed 12 and a sewing head 14 overhanging the bed 12. Journalled in the sewing head 14 is a needle bar 16 which is driven in endwise reciprocatory motion toward and away from a stitch forming location on the bed 12. A needle 18 is attached to the needle bar 16 with a needle clamp 20. Also carried in the sewing head 14 is a presser bar 22 having a presser foot which is shown generally at 24 and which is attached to one extremity thereof with a clamp screw 26. The presser foot 24 cooperates with a feed dog 28 which rises through a throat plate 29 carried in the bed 12 of the sewing machine to feed fabric past the needle 18 in a well known manner.

Figure 5:
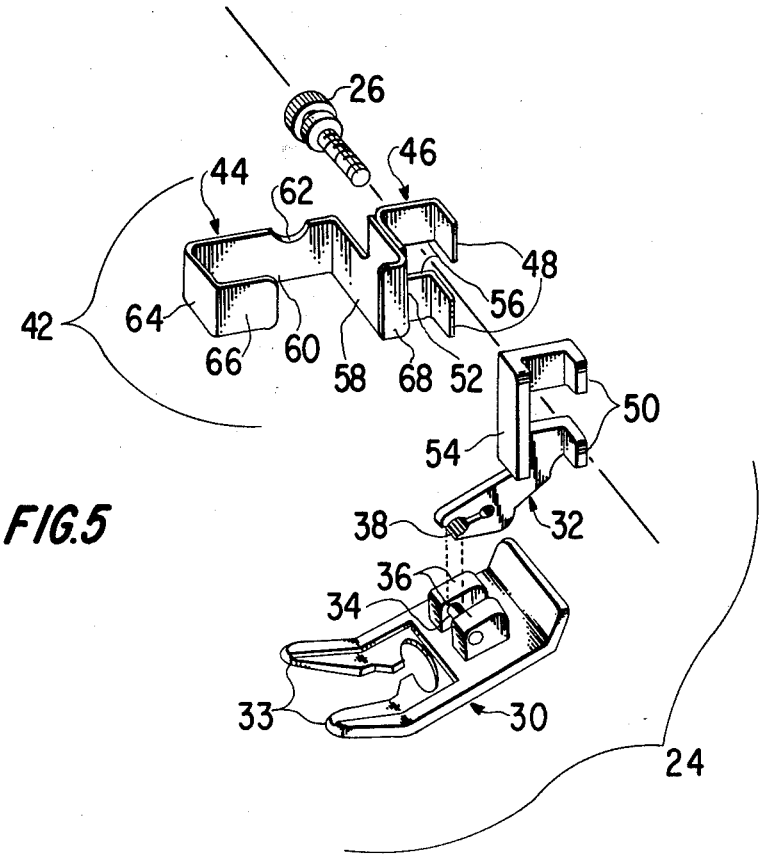
FIG. 5 is a disassembled perspective view showing how the finger guard of this invention is aligned with the presser bar by the shank of the presser foot.

FIG. 5 shows that the presser foot 24 consists of a sole plate portion 30 and a shank portion 32. The sole plate portion 30 is formed with a pair of bifurcated toes 33 extending away from the stitch area. It will be appreciated by one skilled in the art of sewing that the size and shape of the sole plate 30 employed to clamp fabric as it is moved by the feed dog 28 past the stitch forming area is dependent on the nature of the fabric and the stitch pattern sought to be sewn by the operator. It will therefore be apparent that it is advantageous for a sewing machine operator to be able to rapidly and conveniently change the sole plate 30 with a minimum of effort. To that end the sewing machine illustrated herein is shown having a snap-on sole plate 30 of the type disclosed in U.S. Pat. No. 3,489,114 which issued on Jan. 13, 1970 to Seck and which is owned by the assignee of this invention.

Figure 4:
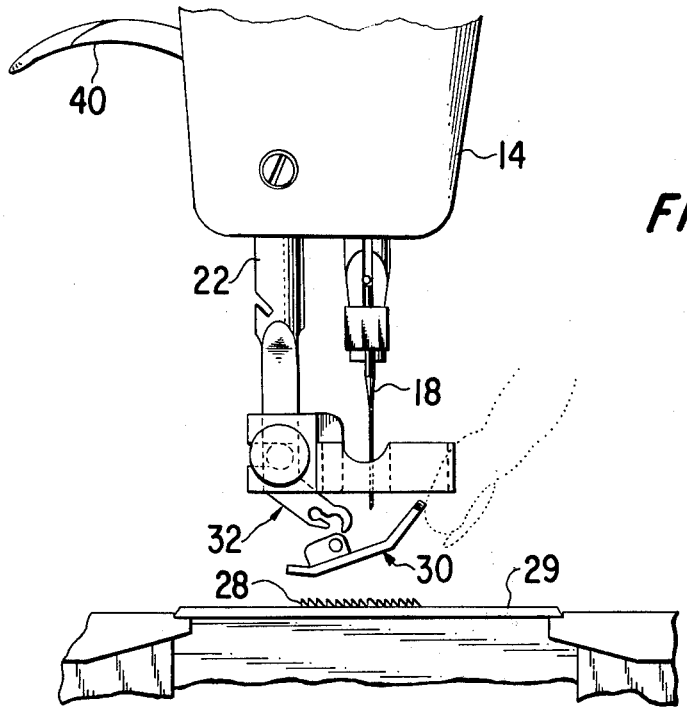
FIG. 4 is a side elevational view similar to FIG. 1 showing the ability to remove a snap-on presser foot with the finger guard of this invention fastened to the presser bar.

The sole plate 30 is secured to the presser foot shank 32 by a cylindrical pivot pin 34 which is carried on the sole plate 30 between a pair of upstanding ears 36. The presser foot shank 32 contains a downturned socket 38 which resistively engages the cylindrical pivot pin 34 when the shank 32 is pressed against the sole plate 30. The sole plate 30 may be disengaged from the shank 32 by arcuate upwardly rotation of the sole plate 30 about the cylindrical pin 34. To that end, it will be appreciated that space must be available within the vicinity of the sole plate 30 to conveniently grasp one of the bifurcated toes 33 of the sole plate 30 and turn it upwardly, as illustrated in FIG. 4.

The shank 32 is attached to the presser bar 22 by the clamp screw 26. The presser bar 22 is provided with an operator influenced presser lifting lever 40 which may be used to disengage the presser foot 24 from contact with the fabric being sewn, thereby making it convenient to reposition or turn the fabric.

One skilled in the art of sewing will further appreciate that the sewing process is consummated by the needle bar 16 reciprocatorily advancing the needle 18 toward and away from the stitch forming area. It will also be apparent that it is necessary for a sewing machine operator to position her hands quite close to the stitch forming area to insure that fabric is accurately fed toward the needle 18, and that an error in hand movement may cause a finger to be placed beneath the reciprocating needle 18. To the end of minimizing the potential danger inherent in a finger being placed in the path of the reciprocating needle 18, but yet to permit convenient removal of the presser foot 24, a finger guard which is shown generally at 42 is attached to the presser bar 22 to guard the space in which the needle 18 reciprocates.

The finger guard 42 is shown in FIG. 5 as having a body portion 44 and a mounting portion 46. Preferably the mounting portion 46 has a pair of out-turned clips 48 which embrace a like pair of out-turned bifurcations 50 carried on the presser foot shank 32. The mounting portion 46 also contains an abutment wall 52 which aligns with an out-turned tab 54 on the presser foot shank 32 to insure the correct positioning of the finger guard 42 relative to the presser foot shank 32. Preferably the finger guard 42 is fastened to the presser bar 22 by passing the clamp screw 26 which clamps the presser foot shank 32 to the presser bar 22 through an aperture 56 which is formed between the out-turned clips 48 of the mounting portion 46 of the finger guard 42.

Figure 3:
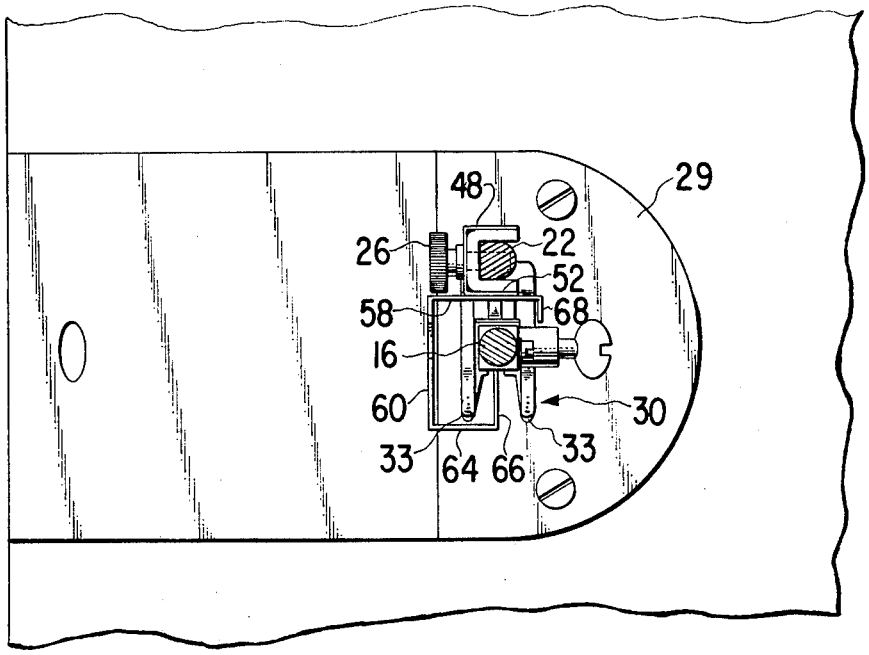
FIG. 3 is an overhead view of a presser bar having the finger guard of this invention attached thereto.

The finger guard body portion 44 is fastened to the mounting portion 46 at a rear element 58 which is preferably fastened to the abutment wall 52 by any convenient means such as soldering or riveting. FIG. 3 shows that the rear element 58 is preferably sufficiently long to extend the body portion 44 of the finger guard 42 beyond the sole plate 30. Preferably a side element 60 extends from the rear element 58 at a substantially normal angle and is preferably long enough to extend beyond the front edge of the sole plate 30. The side element 60 contains an aperture 62 formed along the top edge thereof to accommodate alternate forms of needle clamps, having appendages which require an aperture to permit reciprocation toward the stitch forming area. A front extension 64 is formed at the forward extremity of the elongated side 60 and, as shown in FIG. 3, extends toward the central portion of the sole plate 30. The front extension 64 carries a free extremity 66 which extends inwardly parallel to the side element 60 and toward the needle 18. Preferably the rear element 58 has a tab 68 formed substantially normal thereto which extends outwardly parallel to the side element 60 and in clearance of the sole plate 30.

It will be apparent from FIG. 3 and FIG. 4 that the finger guard 42 is positioned on the presser bar 22 with respect to the needle 18 and the sole plate 30 to permit the sole plate 30 to be easily rotated upwardly and removed from the shank 32 to which it is attached. Preferably a bifurcated toe 33 of the sole plate 30 may be conveniently grasped by the sewing machine operator as shown in FIG. 4 and will not strike the finger guard 42 while being rotated upwardly, thereby encouraging the sewing machine operator to operate the sewing machine with the finger guard 42 in position, even if required to frequently change the sole plate 30 to perform a variety of sewing tasks.

It will be appreciated that what has been disclosed is a novel and useful finger guard which will aid a sewing machine operator to perform the sewing process while reducing the potential for injury occurring from the reciprocating needle. One skilled in the related art may, in the light of the above teachings, become aware of modifications and variations to the preferred embodiment hereinabove described. It is to be understood that variations may be made to the preferred embodiment without departing from the spirit and scope of the invention as defined in the appended claims.

Having thus set forth the nature of this invention, what is claimed herein is:

1. A finger guard for a sewing machine having a needle bar; a needle fastened to said needle bar; a presser bar a presser foot shank having a socket fastened to said presser bar; a presser foot having a work engaging sole plate formed with bifurcated toe portions; detachable connection means comprising a cylindrical pivot pin carried on said sole plate, said pivot pin being resistively engaged in said socket of said presser foot shank to fasten said sole plate to said presser foot shank, said connection means locating said toe portions one on each side of the area penetrated by said needle; said finger guard comprising a mounting portion and a body portion; means for securing said mounting portion to said presser bar; said body portion of said finger guard being joined at one extremity to said mounting portion; said body portion being shaped so as to enclose a space overlying and accommodating only one of said toe portions of said presser foot sole plate and including a free extremity terminating between said bifurcated sole plate toe portions; whereby the other of said presser foot sole plate toe portions is accessible outside the space enclosed by said body portion of said finger guard so that said other toe portion may be grasped and rotated upwardly for disengagement of said presser foot from said shank.

2. The finger guard as set forth in claim 1 wherein said body portion includes a rear element fastened to said mounting portion and extending outward of one of said bifurcated toes; a side element formed at substantially a right angle to said rear element and extending beyond said toes of said sole plate; a front extension extending substantially at a right angle to said side element and terminating at a free extremity formed substantially at a right angle to said front extension and extending intermediate said bifurcated toes.

3. The finger guard as set forth in claim 1 wherein said body portion has a tab extending from said rear element outside of said sole plate and toward the front of said sewing machine.

4. The finger guard as set forth in claim 3 wherein said side element has formed thereon an aperture.

* * * * *